United States Patent [19]

Beck

[11] Patent Number: 5,022,247

[45] Date of Patent: Jun. 11, 1991

[54] HOLDER FOR SPARE SET OF KEYS

[76] Inventor: J. Frederick Beck, 5246 Myrtle Wood, Sarasota, Fla. 34235

[21] Appl. No.: 440,702

[22] Filed: Nov. 24, 1989

[51] Int. Cl.[5] ..... A44B 15/00

[52] U.S. Cl. ..... 70/456 R; 70/458

[58] Field of Search ..... 70/456 R, 457, 458, 70/459; 150/40; 206/37.1-38, 484

[56] References Cited

U.S. PATENT DOCUMENTS

| | | | |
|---|---|---|---|
| 2,219,561 | 10/1940 | Miller | 150/40 |
| 2,756,794 | 7/1956 | Buckett | 150/40 |
| 3,144,935 | 8/1964 | Geyler | 70/456 |
| 3,212,546 | 10/1965 | Lind | 150/40 |
| 4,037,716 | 7/1977 | Marks | 70/456 R X |
| 4,286,641 | 9/1981 | Watson | 150/40 |
| 4,300,610 | 11/1981 | China | 150/40 |
| 4,331,194 | 5/1982 | Lederer | 70/456 R X |
| 4,457,425 | 7/1984 | Cooper et al. | 150/40 |
| 4,637,236 | 1/1987 | Almblad | 70/458 |
| 4,711,347 | 12/1987 | Drexler et al. | 206/38 |
| 4,741,372 | 5/1988 | Santilli | 206/38 X |

FOREIGN PATENT DOCUMENTS 800492 11/1950 Fed. Rep. of Germany .

*Primary Examiner*—Robert L. Wolfe
*Assistant Examiner*—Suzanne L. Dino
*Attorney, Agent, or Firm*—Julian C. Renfro

[57] ABSTRACT

A key holder arrangement for one or a plurality of spare keys, with which advertising may be effectively used, comprising a planar base member approximately the size of a typical business card, and of a thickness approximating the thickness of a key. The base member has opposing faces thereon, and one or more cutouts therein, each cutout being of a size closely conforming to the key to be received, such that the key can be frictionally retained therein. One of the faces of the base member is coated with a pressure sensitive adhesive, with a backer sheet normally residing on the pressure sensitive adhesive, to prevent the base member from adhering to an extraneous object. The backer sheet is to be readily peeled away from the adhesive preparatory to the placement of the backside of a business card in contact with the adhesive, and in careful alignment with the base member.

8 Claims, 1 Drawing Sheet

HOLDER FOR SPARE SET OF KEYS

BACKGROUND OF THE INVENTION

Various kinds of spare key holders are well known in the prior art, and almost all of such devices suffer from distinct disadvantages, such as bulkiness, expense or the like. One such prior art device comprises a card member having slots in which keys are inserted, thus allowing the ends or edges of the keys to extend from the surface of the holder. Such a configuration, however, is undesirable in that the key extensions can catch or bind on clothing, pockets, etc.

Another type of card-like holder consists of a card member having pockets for receiving keys, and means for restraining the keys within the card pockets. Such restraining means typically include adhesive or magnetic strips disposed across the surface of the keys and card or an adhesive film substantially covering the card face which includes the key containing pockets. The use of adhesive or magnetic strips is undesirable in that it is cumbersome; the strips may be easily misplaced and/or become worn after a period of use. The use of a resealable adhesive film is undesirable in that after a period of use, the film may become worn such that it no longer properly adheres to the card holder, thus resulting in the possible loss of the items contained in the holder.

It is the goal of the present invention to improve upon these and other prior art devices, while providing a fine opportunity to a salesman to reap the benefits of a highly effective form of advertising.

SUMMARY OF THE INVENTION

The present invention differs from the prior art by providing a spare key holder or carrier particularly adapted to receive the business card of a salesman or the like, without the salesman having to undertake a substantial expense insofar as providing highly effective advertising material that has been individualized.

The spare key holder in accordance with my invention involves a base member that is smaller, lighter and can be manufactured more inexpensively than the prior art, is typically made of heavy paper, cardboard or the like, in which a pair of cutouts has been carefully created, with such cutouts being designed to closely receive a pair of keys, typically a spare pair of keys to a vehicle, home or the like. The base member of the instant key holder is coated on one side with a pressure sensitive adhesive, with a readily removed backer sheet covering the adhesive, thus to prevent the key holder from becoming affixed to any extraneous item with which it comes into contact prior to affixing a business card.

The key holder in accordance with this invention is created to be precisely the size of the business cards with which it is to be used, so that when the user has peeled away the backer sheet, the user can then place the reverse of his or her business card in contact with the pressure sensitive adhesive. This placement of the business card results in an arrangement serving to help hold the pair of keys in the desired position in the cutouts effectively completing the utility of the invention, and at the same time providing an effective, attractive and indelible form of advertising.

Because my key holder is the size of a typical business card as well as being of minimal thickness, it can be readily carried in a man's or a woman's wallet, in a purse, or in a plastic foldout insert of the type utilized in many wallets and purses.

Should the purchaser of the vehicle or house lose or misplace his or her keys, it is but a simple matter to bring out the card holder in accordance with this invention, and then readily remove the spare keys therefrom.

Most advantageously, because the salesman's card becomes an intrinsic part of the instant key holder, the salesman is able to keep his name as well as his address and telephone number in the forefront insofar as this client is concerned. The typical person losing or misplacing his primary set of keys will be exceedingly glad that the salesman made this carrier for an extra set of keys available, and consequently that person will tend to tell his friends about this helpful and considerate salesman, thus having the effect of directing new business opportunities to the salesman.

The present design avoids many of the inherent disadvantages present when previous efforts were made to utilize adhesives in connection with key holders. The adhesives used in the prior art devices are largely impractical in hot climates, for they are sticky to handle and tend to wear out very quickly. Examples of this are the Drexler U.S. Pat. No. 4,711,347; the Marks U.S. Pat. No. 4,037,716; and the Buckett Pat. No. 2,756,794.

Other prior art patentees have proposed the use of magnetic materials in holding keys in a desired location, but these approaches are expensive, usable only with keys that are attracted by a magnet, and tend to be thicker holders than is desirable.

Still other prior art patentees have resorted to sewing or stitching the key holder devices together, which adds considerably to the cost.

The present invention is characterized by the simplicity of its manufacture, for it involves a sheet of heavy paper or plastic member of flat, planar construction that is die cut so as to create a number of key holders with each press, each the shape of a business card, which typically is rectangular and 2 inches by 3½ inches in size. During the die cutting procedure, two elongate slots precisely the size of the keys to be inserted are cut into each holder, thus to enable a pair of keys to be frictionally retained with a minimum of complexity. Prior to die cutting, a suitable pressure sensitive adhesive and backer sheet is applied to the backside of each sheet of the relatively stiff base member in one simple manufacturing step. Utilization of a backer sheet avoids the possibility of the adhesive becoming affixed to an extraneous item during handling, prior to the application of a business card.

A final step in creating a key holder in accordance with my invention involves printing the key holder with identification, instructions or advertising, either before or after the die cutting procedure.

It is thus to be seen that my novel key holder can be produced at minimal cost, and the die cuts can be readily sized to receive keys fitting a certain configuration.

As is obvious, my novel key holder can be configured to be specific to the keys for a house, automobile, truck or boat, and while typically two slots are cut in the base member to receive the spare keys, it is readily apparent that the design in accordance with this invention can be varied to receive from one to three keys, depending on their size.

In use, the salesman would peel away the backer sheet from the pressure sensitive adhesive layer, and then insert the backside of his own business card carefully in contact with the pressure sensitive adhesive on the rear side of the key holder. The salesman would then insert therein a spare pair of keys for the vehicle or the building that has been sold by the salesman. In this way the salesman is enabled to keep his name, address and telephone number convenient to the user's wallet or purse, without having to go to the expense of printing the body of the key holder to contain this information. Because of this advantageous arrangement, a given company could print all of its key holders alike, leaving it up to each individual salesman to conform the key holders to contain his particular information, including his name, telephone number, and the like.

This highly effective yet economical arrangement represents a definite boon to the purchaser, for it readily identifies the name of the salesman, so that the purchaser can send referrals to the salesman responsible for the kind deed represented by the furnishing of the carrier for an extra pair of keys to the purchaser and in the event of loss, provide a conduit for return to the owner. Since a lockout creates many disadvantages, a spare set of keys will avoid the attendant loss of time, expense and inconvenience.

Not required, but desirable in some instances is a small transparent envelope, of a size to closely receive the key holder and its pair of keys. In the unlikely event that during carrying, the key holder has been bent or distorted such that the keys are forced out of their slots, the keys will obviously be retained in the transparent envelope, thus ensuring against loss. The utilization of the envelope is primarily for women who may elect to carry spare keys in a purse or bag wherein they may be subjected to more battering about than if inserted into a wallet.

It is thus to be seen that a principal object of this invention is to provide a highly effective key holder of minimal cost, readily utilizing a salesperson's business card, and therefore affording considerable advertising value to the salesperson without him or her having to incur any extra printing expense.

It is another object of this invention to make it readily possible for a salesman to present an inexpensive device containing his business card as well as a spare set of keys to a purchaser, which will be a direct benefit to the purchaser as well as endearing the salesman to the purchaser, thus representing a device having highly effective advertising value.

It is yet another object of my invention to provide a key holder that is smaller than previous devices of this general type, that is practical because it can readily accommodate specific key cutouts, and that can be manufactured from two pieces of material at minimal expense.

It is still another object of this invention to provide a key holder made at small cost of biodegradable materials, which can be produced in volume and which can fit without crowding into any purse or wallet.

These and other objects, features and advantages will be more apparent from the appended materials.

DETAILED DESCRIPTION

Figure 1:
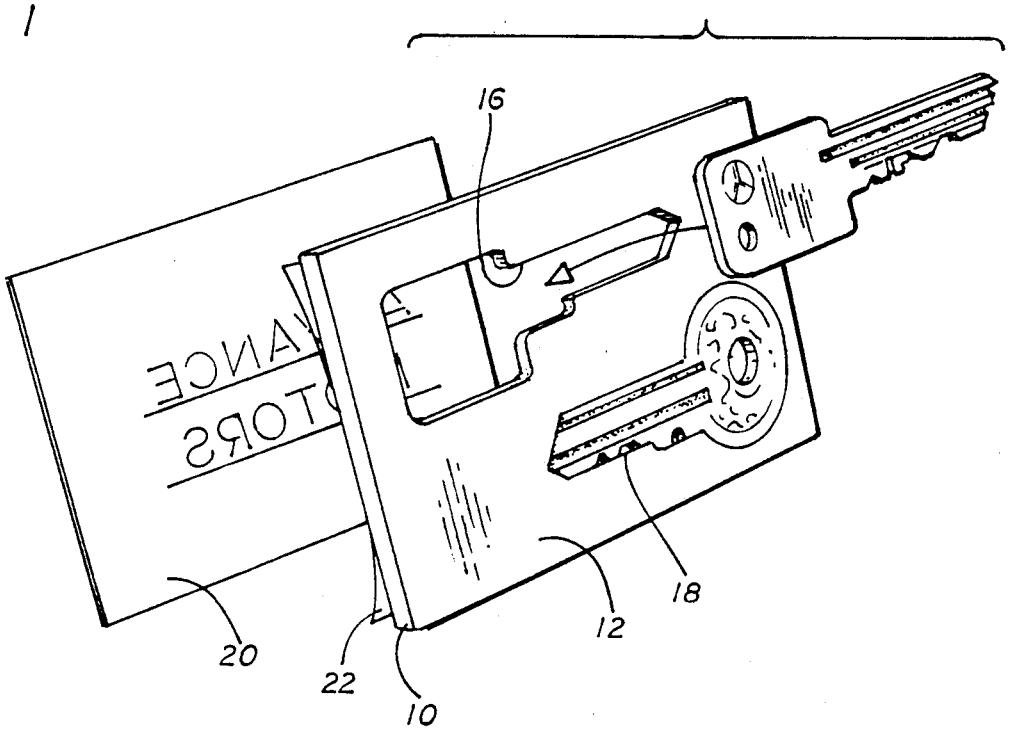
FIG. 1 is a perspective view of the components serving to constitute my novel key holder, comprising the relatively stiff cardboard or plastic member in which a pair of accurately configured key-receiving cutouts are provided, with it to be understood that the backside of a business card containing advertising can be readily applied to pressure sensitive adhesive on the rear side of the key holder, when the backer sheet has been peeled away.

With initial reference to FIG. 1 it will there be seen that I have depicted a typical configuration of a key holder arrangement in accordance with this invention, this involving a planar base member 10 exactly the size of a business card to be used therewith. The typical business card utilized in the United States measures 2 inches by 3½ inches, but obviously I am not to be limited to the base member being exactly of that size.

The base member 10 has opposing faces 12 and 14 thereon, with face 12, visible in FIGS. 1 and 2, being hereinafter referred to as the front face, and with face 14, visible in a phantom manner in FIG. 3, hereinafter referred to as the rear face.

Figure 2:
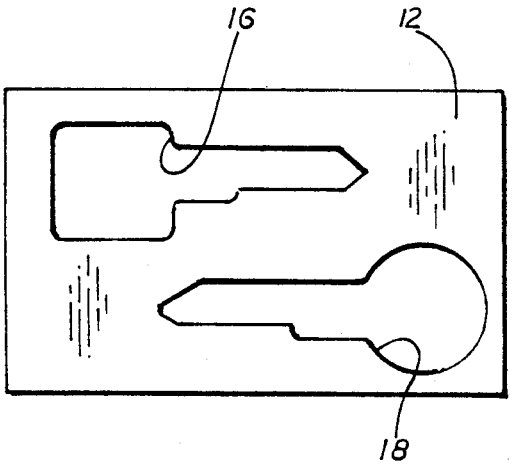
FIG. 2 is a plan view of a key holder in accordance with this invention, revealing the typical placement of the accurately configured key-receiving slots in the key holder.
Figure 3:
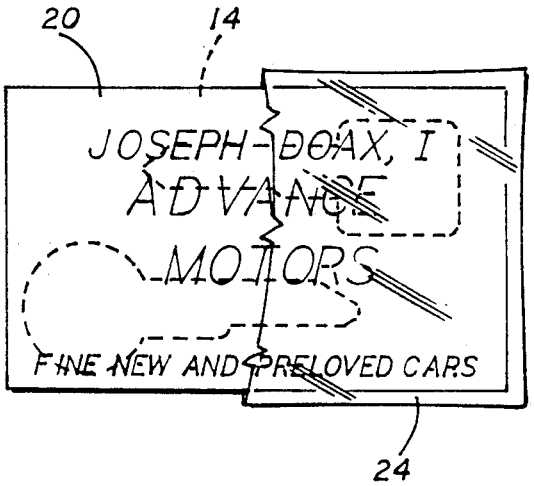
FIG. 3 is a view of the key holder after the salesman's card has been applied to the pressure sensitive adhesive utilized on the rear face of the key holder.

A pair of cutouts 16 and 18 are to be noted in FIGS. 1 and 2, with these cutouts being precisely the size of the key blanks of the keys that will be cut for each lock in which the keys are to be received, such that the keys will be readily retained by friction in the respective cutouts. The thickness of the base member 10 is such as to closely approximate the thickness of the keys to be frictionally retained in the cutouts 16 and 18, usually being only very slightly greater than key thickness. I may use either heavy paper, commonly termed poster board, or a suitable plastic in the construction of the base member 10, although I am not to be limited to any single constructional material.

Quite obviously, my key holder is lighter, less bulky and less expensive than comparable items of the prior art.

On the front face 12 of the key holder device may be printed certain advertising, for example with regard to a motor car company that is to use this novel device in connection with the sale of their automobiles, or with regard to a realty company concerned with the sale of houses. The advertising on the front face 12 is obviously not to be limited to the automobile company or the realty company, for also contained thereon may be a title informing any user of its purpose plus instructions calling attention to the peel-off backing and the ability of this key carrier to readily receive a business card.

It is a very important purpose of this invention to provide a key holder whose one face, here the rear face, is coated with a pressure sensitive adhesive covered with a peel-off sheet 22, so that the auto salesperson, realtor, insurance executive or persons in other related industries may remove the peel-off sheet and then cause the rear surface of his or her business card 20 to adhere to the rear face of the base member. In this way the application of the business card aids in the retention of the spare keys in the base member. The business card should of course be oriented such that the printed side of the card will be visible upon the purchaser turning the base member to view its rear face.

By causing the cutouts 16 and 18 to be of a size and configuration closely agreeing with the size and configuration of the keys to be used with the base member, the keys will not become displaced from the base member in normal use, and no closure member need be applied to the front face of the base member. The key holder is constructed for insertion in any pocket or foldout member of a wallet, for its thickness, size and weight are minimal. It may be desirable, however, to place the base member after key insertion into a small transparent plastic envelope for presentation. The provision of such a transparent envelope, a fragmentary showing 24 of which is visible in FIG. 3, will particularly accommodate a lady who may wish to carry the key holder and keys in a purse or bag, wherein the keys could possibly be forced out of their proper positions in the base member during the handling of the bag.

It is to be borne in mind that my novel key holder arrangement can be utilized with one key, or a plurality of spare keys. The base member, made of paper, plastic or other biodegradable material, has opposing faces thereon, and one or more cutouts therein, each cutout being of a size closely conforming to the key to be received, such that the key can be frictionally retained therein. One of the faces of the base member is coated with a pressure sensitive adhesive, with a backer sheet normally residing on the pressure sensitive adhesive, to prevent the base member from adhering to an extraneous object. The backer sheet is to be readily peeled away from the adhesive preparatory to the placement of the backside of a business card in contact with the adhesive, and in careful alignment with the base member.

This invention is not to be limited, except as required by the scope of the appended claims.

I claim:

1. A key holder arrangement for a spare key, with which advertising in the form of a selected business card may be effectively used, said arrangement comprising a planar base member approximately the size of a typical business card, and of a thickness approximately the thickness of a key, said base member having opposing faces thereon, and a cutout therein, said cutout being of a size closely conforming to the key to be received, such that a key can be inserted into said cutout, and be frictionally retained therein, one of said faces being coated with a pressure sensitive adhesive, a backer sheet normally residing on said pressure sensitive adhesive, to prevent said base member from adhering to an extraneous object, said planar base member in combination with a selected business card, such that upon said backer sheet being peeled away from the adhesive, the placement of the backside of a business card in contact with the adhesive can be accomplished, and in careful alignment with said base member.

2. The key holder arrangement as recited in claim 1 in which said planar base member is made of heavy paper.

3. The key holder arrangement as recited in claim 1 in which said planar base member is made of plastic.

4. The key holder arrangement as recited in claim 1 in which said planar base member is placed in a transparent, closely fitting envelope, to retain therein against loss, the key being forced out of its cutout upon said base member undergoing distortion while being carried in a purse or the like.

5. A key holder arrangement for a spare set of keys, with which advertising in the form of a selected business card may be effectively used, said arrangement comprising a planar base member approximately the size of a typical business card, and of a thickness approximating the thickness of a key, said base member having opposing faces thereon, and a pair of cutouts therein, each cutout being of a size closely conforming to the key to be received, such that a pair of keys can be inserted into the respective cutouts, and frictionally retained therein, one of said faces being coated with a pressure sensitive adhesive, a backer sheet normally residing on said pressure sensitive adhesive, to prevent said base member from adhering to an extraneous object, said planar base member in combination with a selected business card, such that upon said backer sheet being peeled away from the adhesive, the placement of the backside of a business card in contact with the adhesive can be accomplished, and in careful alignment with said base member.

6. The key holder arrangement as recited in claim 5 in which said planar base member is made of heavy paper.

7. The key holder arrangement as recited in claim 5 in which said planar base member is made of plastic.

8. The key holder arrangement as recited in claim 5 in which said planar base member is placed in a transparent, closely fitting envelope, to retain therein against loss, any keys forced out of their respective cutouts upon said base member undergoing distortion while being carried in a purse or the like.

* * * * *